US008844688B2

(12) United States Patent
Pedersen

(10) Patent No.: US 8,844,688 B2
(45) Date of Patent: Sep. 30, 2014

(54) MOUSE HOLE DAMPER DEVICE

(75) Inventor: Jan Erik Pedersen, Kristiansand S (NO)

(73) Assignee: National Oilwell Norway AS, Kristiansand S (NO)

( * ) Notice: Subject to any disclaimer, the term of this patent is extended or adjusted under 35 U.S.C. 154(b) by 644 days.

(21) Appl. No.: 13/126,729

(22) PCT Filed: Oct. 26, 2009

(86) PCT No.: PCT/NO2009/000369

§ 371 (c)(1),
(2), (4) Date: Jun. 8, 2011

(87) PCT Pub. No.: WO2010/050821

PCT Pub. Date: May 6, 2010

(65) Prior Publication Data

US 2011/0233017 A1 Sep. 29, 2011

(30) Foreign Application Priority Data

Oct. 30, 2008 (NO) ..... 20084569

(51) Int. Cl.

| | |
|---|---|
| ***F16F 7/12*** | (2006.01) |
| ***E21B 41/00*** | (2006.01) |
| ***E21B 19/00*** | (2006.01) |
| ***E21B 19/14*** | (2006.01) |

(52) U.S. Cl.

CPC ..... *E21B 19/14* (2013.01); *E21B 41/00* (2013.01); *E21B 19/00* (2013.01)

USPC ..... 188/377; 211/70.4

(58) Field of Classification Search

USPC ..... 188/371–377; 211/70.4

See application file for complete search history.

(56) References Cited

U.S. PATENT DOCUMENTS

| | | | | | |
|---|---|---|---|---|---|
| 690,676 | A | * | 1/1902 | Tait | 166/243 |
| 3,039,757 | A | | 4/1960 | Barr | |
| 3,252,548 | A | * | 5/1966 | Pajak et al. | 188/377 |
| 3,376,031 | A | | 4/1968 | Lee | |
| 3,552,525 | A | * | 1/1971 | Schudel | 188/377 |
| 3,851,911 | A | * | 12/1974 | Brooks | 293/133 |
| 3,966,054 | A | * | 6/1976 | Kelly | 211/70.4 |
| 4,880,088 | A | * | 11/1989 | De Oliveira | 188/377 |
| 5,107,705 | A | * | 4/1992 | Wraight et al. | 73/152.03 |
| 5,131,470 | A | * | 7/1992 | Miszewski et al. | 166/297 |

(Continued)

FOREIGN PATENT DOCUMENTS

| | | | |
|---|---|---|---|
| CN | 201016283 | Y | 2/2008 |
| GB | 2276697 | A | 5/1994 |
| WO | 2007043891 | A1 | 4/2007 |
| WO | 2008035977 | A1 | 3/2008 |

OTHER PUBLICATIONS

International Application No. PCT/US2009/000369 Search Report and Written Opinion dated Jan. 22, 2010.

*Primary Examiner* — Bradley King
(74) *Attorney, Agent, or Firm* — Conley Rose, P.C.

(57) ABSTRACT

A mouse hole damper device positioned at the bottom portion of a mouse hole pipe, the mouse hole damper being arranged to dampen an impact from an object falling in the mouse hole pipe, and the mouse hole damper including a material which has been worked into forming walls around elongated openings, and the material being arranged in such a way that the openings are substantially parallel to the longitudinal axis of the mouse hole pipe.

19 Claims, 2 Drawing Sheets

(56) References Cited

U.S. PATENT DOCUMENTS

| | | | | | |
|---|---|---|---|---|---|
| 5,247,897 | A * | 9/1993 | Pepp | 114/219 |
| 5,419,416 | A * | 5/1995 | Miyashita et al. | 188/371 |
| 5,468,121 | A | 11/1995 | Stogner | |
| 6,004,066 | A * | 12/1999 | Niemerski | 404/6 |
| 6,439,358 | B1 * | 8/2002 | Bruck et al. | 188/377 |
| 6,460,667 | B1 * | 10/2002 | Bruck et al. | 188/371 |
| RE41,988 | E * | 12/2010 | Oberth et al. | 404/6 |
| 8,052,370 | B2 * | 11/2011 | Dekker et al. | 414/22.66 |
| 2011/0226574 | A1 * | 9/2011 | Chen et al. | 188/377 |
| 2012/0175326 | A1 * | 7/2012 | Lunde | 211/70.4 |

* cited by examiner

MOUSE HOLE DAMPER DEVICE

CROSS-REFERENCE TO RELATED APPLICATION

This application is the U.S. National Stage under 35 U.S.C. §371 of International Patent Application No. PCT/NO2009/000369 filed Oct. 26, 2009, which claims priority to Norwegian Patent Application No. 20084569 filed Oct. 30, 2008, entitled "Mouse Hole Damper Device."

STATEMENT REGARDING FEDERALLY SPONSORED RESEARCH OR DEVELOPMENT

Not applicable.

BACKGROUND

This invention relates to a mouse hole damper. More particularly, it relates to a mouse hole damper positioned in the lower portion of a mouse hole, the mouse hole damper being arranged to dampen the impact from an object falling in the mouse hole.

So-called mouse holes, which are often arranged in a drilling floor, are used when adding and removing pipe sections. The mouse hole typically includes a mouse hole pipe extending downwards from an opening in the drilling floor, the mouse hole pipe being arranged to guide and also intermediately store a pipe which is in the mouse hole. Several coordinate mouse hole pipes may be arranged for a common mouse hole opening, the mouse hole pipes being arranged to be moved into position below the actual mouse hole opening.

If a pipe is dropped during work in the mouse hole, there may be a risk that the impact energy, as the bottom portion of the mouse hole pipe is hit, is sufficient for the falling pipe to break through the bottom portion and continue falling.

It is known to arrange a mouse hole damper at the lower portion of the mouse hole, that is to say at the bottom portion of the mouse hole pipe. According to the prior art, a mouse hole damper includes a relatively complicated and expensive structure which must be replaced after having been activated.

The invention has for its object to remedy or reduce at least one of the drawbacks of the prior art.

The object is achieved according to the invention through the features which are specified in the description below and in the claims that follow.

BRIEF DESCRIPTION OF THE DRAWINGS

In what follows is described an example of a preferred embodiment which is visualized in the accompanying drawings, in which.

DETAILED DESCRIPTION

Figure 1:
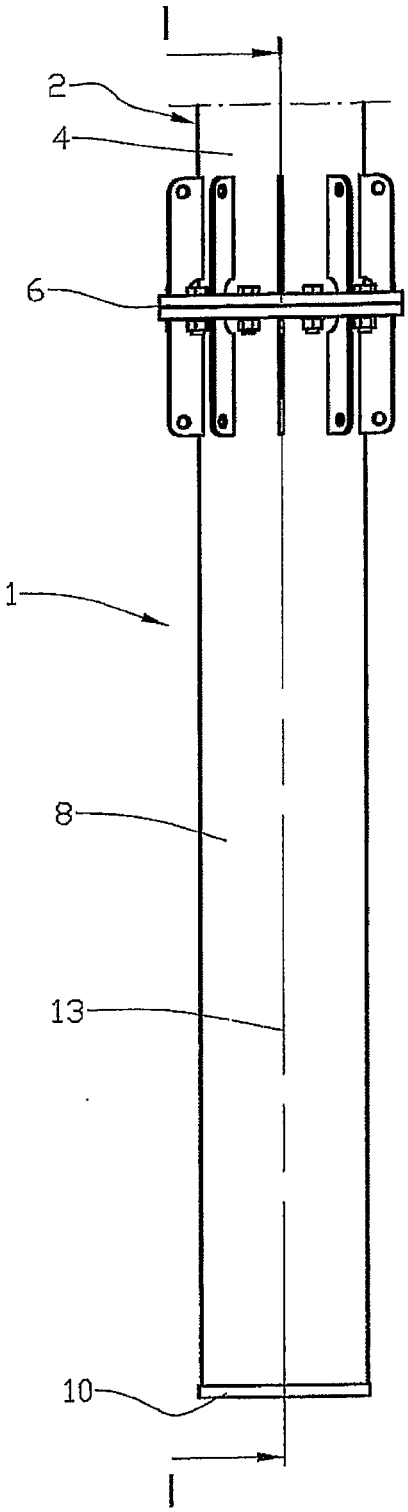
FIG. 1 shows a mouse hole damper in accordance with the invention.
Figure 2:
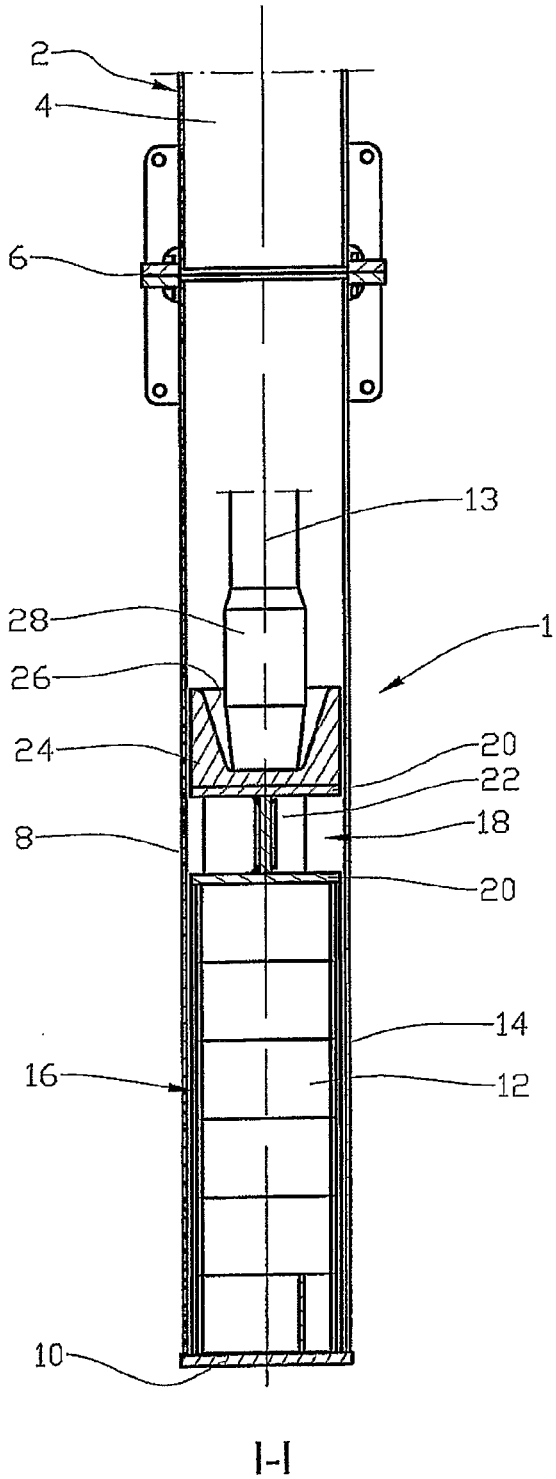
FIG. 2 shows a section I-I of FIG. 1.

In the drawings and description that follow, like parts are typically marked throughout the specification and drawings with the same reference numerals, respectively. Certain terms are used throughout the description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

The terms "including" and "comprising" are used in an open-ended fashion, and thus should be interpreted to mean "including, but not limited to . . . ." Unless otherwise specified, any use of any form of the terms "couple", "attach", "connect" or any other term describing an interaction between elements is not meant to limit the interaction to direct interaction between the elements and may also include indirect interaction between the elements described. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

A mouse hole damper has been provided, which is located at the bottom portion of a mouse hole pipe, the mouse hole damper being arranged to dampen an impact from an object falling in the mouse hole. The mouse hole damper is characterized by including a material which has been worked into forming walls around elongated openings, the material being arranged in such a way that the openings are, in the main, parallel to the longitudinal axis of the mouse hole.

A falling object striking against the worked material is retarded by the velocity energy deforming the worked material.

The wall thickness of the worked material may be less than 0.1 times the width of opening of an adjacent opening. If desirable, the wall thickness of the worked material may be less than 0.05 times the width of opening of an adjacent opening.

The worked material may be formed as a damper element with a plurality of elongated openings.

A damper element may be designed to provide a desired retardation profile. By retardation profile is meant the energy absorbed as a function of length of deformation. The retardation profile is dependent on, inter alia, the wall thickness of the worked material, the proportion of the cross-sectional area of the damper element filled with worked material, and the firmness and deformation properties of the worked material. As is known, a worked material with relatively thin walls will have a longer way of deformation when absorbing a certain amount of energy than a material with thicker walls.

A damper element may include several different worked materials.

At least two damper elements may be placed on top of each other in the direction of the longitudinal axis of the mouse hole. By choosing worked materials with different deformation properties for the different damper elements, the deformation profile may be controlled in form and value within a relatively wide range.

The worked material may be rolled up into forming a damper element, for example from a sheet, in which two layers of worked material in a corrugated form constitute the surface of the plate. The elongated openings are between the layers. Other manufacturing methods may include extrusion, for example.

The worked material may have a honeycomb structure in cross section. Materials having a honeycomb structure are relatively easily available and well suited for the purpose. Among other possible cross-sectional shapes, curved cross sections may be mentioned, such as circular or oval ones, or other polygonal cross sections such as quadrilateral or octagonal ones. It is also relevant to have a round core of corrugated aluminium.

The mouse hole damper may include a load distributor, for example in the form of a plate which is placed over the damper element and which is arranged to distribute the force from a falling object over as much of the cross section of the damper element as possible.

The mouse hole damper may be provided with a guide which is arranged to guide the object in towards the centre axis of the damper element before the object gets into contact with the load distributor.

The load distributor and guide may form part of a lift in the mouse hole pipe. This lift, which is often arranged to adjust the height of a bottom stop in the mouse hole pipe, is often termed a "rabbit".

The device according to the invention provides a relatively cost-effective mouse hole damper in which the deformation profile of the damper can easily be adjusted to the prevailing conditions.

In the drawings, the reference numeral 1 indicates a mouse hole damper which is connected to the bottom portion 4 of a mouse hole 2 by means of a flange connection 6.

The mouse hold damper 1 includes a pipe portion 8 which is connected to the flange connection 6 and provided, at its opposite end portion, with an end cover 10.

A number of damper elements 12 are placed on top of each other parallel to the common centre axis 13 of the damper 1 and mouse hole pipe 2. The damper elements 12 are placed in a sleeve-shaped holder 14, thus forming an easily replaceable cartridge 16.

A distributor 18 is disposed above the cartridge 16, the distributor 18, which includes two disc-shaped plates 20 with an intermediate piece 22, being arranged to distribute a force over the cross section of the cartridge 16 and thereby over the cross section of the damper elements 12.

A guide 24 with a centric conical opening 26 is placed above the distributor 18 and arranged to guide a falling object 28, here in the form of a drill pipe, in towards the centre axis 13.

Figure 3:
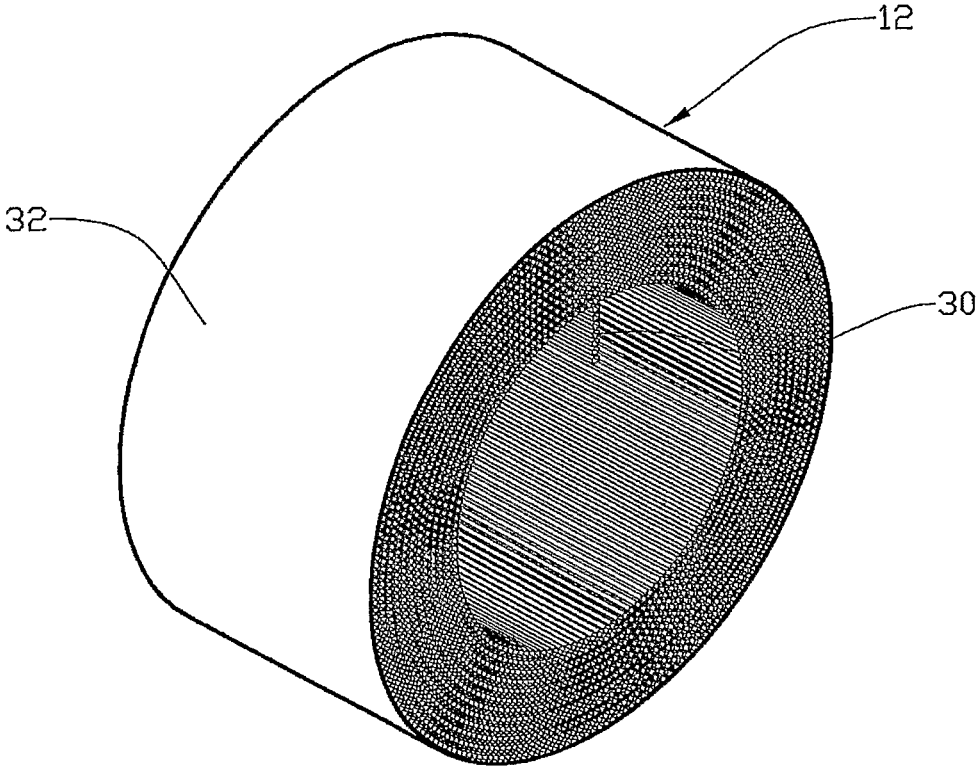
FIG. 3 shows, on a larger scale and in perspective, a damper element.

In this preferred embodiment, the damper element 12 is rolled up from a plate 30, see FIG. 3, and the damper element 12 is then enveloped in a casing material 32, here in the form of kevlar.

Figure 4:
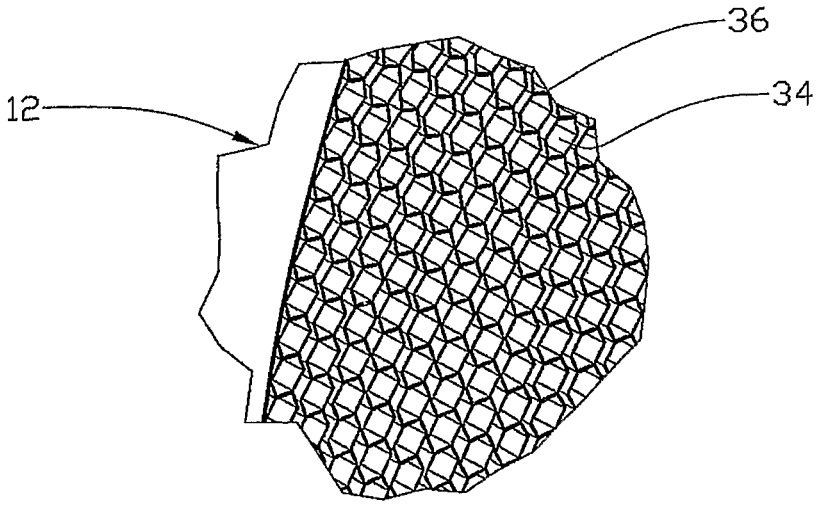
FIG. 4 shows, on a still larger scale, a section of FIG. 3.

In FIG. 4 is shown each layer in which elongated openings 34 are surrounded by worked material 36.

If an object 28 falls into the mouse hole pipe 2, the object 28 is guided by means of the guide 24 in towards the centre axis 13 before impacting. The force from the impact is transmitted via the distributor 18 to the cartridge 16 with the damper elements 12. The damper elements 12 deform to different extents according to their resistance to deformation.

The energy from the impact is thereby absorbed by the damper elements 12. The falling object 28 is stopped without causing any harm to other equipment or personnel.

While specific embodiments have been shown and described, modifications can be made by one skilled in the art without departing from the scope or teachings herein. The embodiments as described are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described, but is only limited by the claims that follow, the scope of which shall include all equivalents of the subject matter of the claims.

What is claimed is:

1. A mouse hole damper device positioned at the bottom portion of a mouse hole pipe, the mouse hole damper device being arranged to dampen an impact from an object which is falling in the mouse hole pipe, the mouse hole damper device comprising:

a material which has been worked into forming walls around elongated openings, the material being arranged in such a way that the openings are substantially parallel to the longitudinal axis of the mouse hole pipe;

a guide configured to guide the object toward a centre axis of the mouse hole damper device; and a distributor configured to distribute forces applied to the mouse hole damper device, wherein the distributor includes an upper plate, a lower plate, and an intermediate piece extending between the upper plate and the lower plate.

2. The device according to claim 1, wherein a wall thickness of the worked material is smaller than 0.1 times the width of an adjacent opening.

3. The device according to claim 1, wherein a wall thickness of the worked material is less than 0.05 times the width of an adjacent opening.

4. The device according to claim 1, wherein the worked material is formed as a damper element with a plurality of elongated openings.

5. The device according to claim 1, wherein at least two damper elements are placed on top of each other in the direction of the longitudinal axis of the mouse hole pipe.

6. The device according to claim 1, wherein the at least two damper elements which are placed on top of each other are dissimilar with respect to retardation properties.

7. The device according to claim 1, wherein a cross section of the worked material has at least a honeycomb structure or a round core which is made of corrugated aluminum.

8. The device according to claim 1, wherein the worked material is rolled up into a roll forming a damper element.

9. The device according to claim 1, wherein the worked material is encased in a casing material.

10. The device according to claim 9, wherein the casing material is para-aramid fiber.

11. A mouse hole pipe, the mouse hole damper device being arranged to dampen an impact from an object which is falling in the mouse hole pipe, the mouse hole damper device comprising:

a plurality of damper elements comprising a material which has been worked into forming walls around elongated openings, wherein each of the openings is substantially parallel to the mouse hole pipe:

a guide configured to guide the object toward the damper elements; and a distributor configured to distribute forces applied to the damper elements;

wherein the plurality of damper elements are arranged one on top of the other;

wherein the distributor comprises an upper plate, a lower plate, and an intermediate piece extending between the upper and lower plates.

12. The device according to claim 11, wherein the guide is configured to guide the object toward a centre axis of the mouse hole damper.

13. The device according to claim 11, wherein a wall thickness of the worked material is smaller than 0.1 times the width of an adjacent opening.

14. The device according to claim 11, wherein a wall thickness of the worked material is less than 0.05 times the width of an adjacent opening.

15. The device according to claim 11, wherein the at least two of the plurality of damper elements are dissimilar with respect to retardation properties.

16. The device according to claim 11, wherein a cross section of the worked material has at least a honeycomb structure or a round core which is made of corrugated aluminum.

17. The device according to claim 11, wherein at least one damper element is formed from rolling the worked material into a roll.

18. The device according to claim 11, wherein the worked material is encased in a casing material.

19. The device according to claim 18, wherein the casing material is para-aramid fiber.

* * * * *